US009486683B2

(12) United States Patent
Goodgame

(10) Patent No.: US 9,486,683 B2
(45) Date of Patent: Nov. 8, 2016

(54) SYSTEM AND METHOD FOR TEACHING BATTING SKILLS

(71) Applicant: Keith Brady Goodgame, Houston, TX (US)

(72) Inventor: Keith Brady Goodgame, Houston, TX (US)

( * ) Notice: Subject to any disclaimer, the term of this patent is extended or adjusted under 35 U.S.C. 154(b) by 0 days.

(21) Appl. No.: 14/559,537

(22) Filed: Dec. 3, 2014

(65) Prior Publication Data

US 2015/0265895 A1 Sep. 24, 2015

Related U.S. Application Data

(63) Continuation-in-part of application No. 13/923,726, filed on Jun. 21, 2013, now abandoned.

(60) Provisional application No. 61/662,590, filed on Jun. 21, 2012.

(51) Int. Cl.
*A63B 69/00* (2006.01)
*A63B 69/36* (2006.01)

(52) U.S. Cl.
CPC ..... *A63B 69/0002* (2013.01); *A63B 69/0057* (2013.01); *A63B 69/3667* (2013.01); *A63B 2069/0006* (2013.01); *A63B 2069/0008* (2013.01); *A63B 2102/182* (2015.10); *A63B 2208/12* (2013.01); *A63B 2210/50* (2013.01); *A63B 2225/09* (2013.01)

(58) Field of Classification Search
CPC ..... A63B 69/0002; A63B 69/3673; A63B 69/00; A63B 21/0004; A63B 24/0021; A63B 2069/0008; A63B 69/3667; A63B 2069/0006; A63B 69/0057
USPC ..... 473/422, 218, 452, 270, 207, 273; D21/780, 689, 662; 482/57, 79, 80, 482/146, 70
See application file for complete search history.

(56) References Cited

U.S. PATENT DOCUMENTS 3,244,421 A * 4/1966 Hanna ..... A63B 69/3667 473/273
3,384,377 A * 5/1968 Stipp ..... A63B 69/3667 473/218
4,516,772 A * 5/1985 Stratton ..... A63B 69/0002 473/273
5,076,580 A * 12/1991 Lang ..... A63B 69/0002 473/273
5,810,673 A * 9/1998 Castleberry ..... A63B 69/3673 473/217
D399,280 S * 10/1998 Griffin ..... D21/753
5,976,026 A * 11/1999 Erb ..... A63B 69/0002 473/270
5,976,027 A * 11/1999 Kachmar ..... A63B 69/3667 473/273
6,723,004 B1 * 4/2004 Florian ..... A63B 69/3667 473/270
6,945,883 B1 * 9/2005 Williams ..... A63B 69/0002 473/422
7,083,178 B2 * 8/2006 Potter ..... A63C 17/004 280/87.042
D602,553 S * 10/2009 Wright ..... D21/780
7,658,700 B2 * 2/2010 Maloy ..... A63B 23/1209 273/449
7,955,181 B2 * 6/2011 Drollinger ..... A63B 69/3673 473/272
8,221,271 B1 * 7/2012 McIntyre ..... A63B 69/0002 473/452
8,371,963 B2 * 2/2013 DelGreco ..... A63B 69/0002 473/422
9,155,954 B2 * 10/2015 Newman ..... A63B 69/3673 473/452

* cited by examiner

*Primary Examiner* — Mitra Aryanpour
(74) *Attorney, Agent, or Firm* — Raymond R. Ferrera; Adams and Reese LLP

(57) ABSTRACT

Device and methods for teaching batting skill are disclosed having front and rear foot pads and at least one release point. A stride pad may be included and aligned with the rear pad and a pitching location/source. The front rear pad provides for adjustment out of linear alignment with the rear pad and the stride pad to accommodate open and closed stances. The device admits to multiple position settings and variable stances, and the related methods will help teach baseball and softball players to adopt and use a correct and confident stance, stride and swing.

14 Claims, 7 Drawing Sheets

SYSTEM AND METHOD FOR TEACHING BATTING SKILLS

FIELD

The present invention relates generally to methods of assisting baseball and softball players with proper foot placement, batting stance, stride and swing; and in a particular, though non-limiting embodiment to a batting training device that is portable, easy to assemble and easily used by parents, coaches and children to safely and efficiently teach or learn basic batting skills through muscle memory.

BACKGROUND

Parents and coaches alike struggle teaching inexperienced children rudimentary sporting skills; with baseball and softball in particular, teaching young players proper batting techniques is especially problematic. Currently, adults utilize techniques ranging from the rudimentary tactic of drawing lines or placing bats in the dirt, to holding players' ankles in fixed positions with hands or cords.

Other known techniques rely on more complicated instructional devices, which are generally not effective for teaching correct foot placement, stance, stride or swing characteristics to inexperienced or poorly trained children. As children become more experienced and independent, they tend to replicate substandard techniques learned from others, utilize the same incomplete or ineffective instructional devices with which they are familiar, and/or attempt to teach themselves with no practical guidance.

Also, versatility and ease of use critical to any foot placement, batting stance, stride and swing tool are not satisfactorily addressed by the prior art. For example, some current devices are incomplete, failing to address one or more of these key batting skills; are too heavy or bulky or difficult to assemble/disassemble; and/or are not capable of adjusting to the sizes or needs of different children or children as they grow.

Moreover, most current devices rely solely upon a neutral stance option, with no option for an open or closed stance. Even devices allowing for an angled stance fail to account for proper stride alignment. As those of skill in the pertinent arts will readily appreciate, however, different types of stances can affect how far a batter can reach over the plate and how well the batter can see pitches. As children age and grow, progressing from non-pitch to pitch baseball, stance becomes increasingly important, and provides more experienced batters with tactical advantages that enhance their individual skill sets.

Additionally, many devices stand several inches off the ground (measured from the base to a stance position), which is sub-optimal for younger or less experienced batters. Because such devices attempt to show batters to step back at the pitcher with their lead foot, the height of the devices impart a significant risk for injury to younger players with less developed senses of balance and timing.

Given the limitations in the current art, there is need for a device which is lightweight, safe and adaptable for every child within the targeted user spectrum, which can be used to teach or learn proper foot placement, batting stance, stride and swing.

SUMMARY

The invention shown and described herein overcomes the problems of the prior art by combining a simple but comprehensive system of adjustable, pivoting foot pads; a stride pad; extension bars; pull pins; pinwheel assembly points; and release points, which, when used in accord with the disclosed method, will safely and effectively teach proper foot placement, stance, stride and swing. The device is fully portable, and can be used by varying age groups, to establish and retain proper muscle memory for effective batting.

In a detailed though non-limiting embodiment, the system comprises at least the following elements: two extension bars, adjustable to fit the size of the user stance and stride, optimally equipped with foot pads disposed at either end; a lead foot pad and a reversible rear pad, adjustable for right or left handed batters, with the pads made from two separate layers of rubberized material including a bottom layer made of polyurethane capable of adhering to concrete, cement or other materials; and a top layer made with a rubberized polyurethane binder over a prepared substrate, with pigmented EPDM rubber granules and an aliphatic binder to create a wear resistant but adhesive surface for cleats or tennis shoes; one stride pad, adjustable for either right or left handed batters; two pull pins attached to the extension bars to allow the bars to extend or collapse based on the size and stance of the batter or for storage; two pinwheel assembly points, used to lock the foot pads in place once the batter is comfortable with the stance (open, neutral, closed); and two release points embedded into the rear foot pad to help release the hips and turn the body through the swing.

In an exemplary embodiment of the present invention, a batting training device is provided, having: a rear foot pad having at least one release point; and a front foot pad. The rear foot pad is aligned such that an interior side of a foot placed thereon is substantially aligned towards a pitcher. The front foot pad is adjustable, allowing for a range of closed and open stance alignments. The at least one release point is configured to allow a user of the device to pivot at the at least one release point during a batting swing.

The training device may have a stride pad that is in alignment with the rear foot pad towards the pitcher. The training device may have a first extension bar disposed between the rear foot pad and the front foot pad. The first extension bar may be adjustable such that a distance between the rear foot pad and the front foot pad may be increased or decreased. The training device may have a second extension bar disposed between the stride pad and the front foot pad. The second extension bar may be adjustable such that a distance between the stride pad and the front foot pad may be increased or decreased. The second extension bar may be removably attached to the front foot pad such that the second extension bar and the stride pad may be detached from the training device.

The training device may have two release points located in the rear foot pad with a first release point allowing for right-handed training and a second release point allowing for left-handed training.

The first and second extension bars may have pull pins and a plurality of pin holes configured to lock the first and second extension bars into place. The rear foot pad may be reversible. The training device may have a pinwheel assembly configured to allow adjustment of the front foot pad.

The training device may have: a main rail; a rear foot pad assembly; front foot pad assembly; and a stride pad assembly. The rear foot pad assembly may be attached to a first end of the main rail and the front foot pad assembly adjustably attaches to the main rail at a variety of distances from the rear foot pad assembly. The stride pad assembly adjustably may attach to the main rail at a variety of distances from the front foot pad assembly. The training device may have two release points. The stride pad assembly and the front foot pad assembly may include pins configured to engage pin holes along the main rail such that the stride pad assembly and the front foot pad assembly can be locked into place at desired locations along the main rail. The rear foot pad assembly may have the rear foot pad; support cleats; and a rear foot pad liner. The front foot pad assembly may have a front foot pad base adjustably attached to the main rail; and the front foot pad adjustably attached to the front foot pad base. The front foot pad base may be configured to allow the distance between the rear foot pad assembly and the front foot pad assembly to be adjusted. The front foot pad and the front foot pad base may be configured to allow the front foot pad to be locked into place at locations along the front foot pad base such that a batter's stance alignment may be adjusted to an open stance, a closed stance, or a neutral stance. A distance between the front foot pad and rear foot pad may be adjustable from approximately 9 inches to approximately 18 inches.

In an exemplary embodiment of the present invention, a method of teaching batting skills is provided, including: adjusting a training device to accommodate a preferred stance for a user, the training device, having: a rear foot pad having at least one release point; and a front foot pad; the rear foot pad is aligned towards a pitcher; the front foot pad is adjustable allowing for a range of closed and open stance alignments; the at least one release point is configured to allow a user of the device to pivot at the at least one release point during a batting swing; and repeatedly training the user on the training device to develop muscle memory. The method of teaching batting skills may include adding a stride pad to the training device and adjusting a distance between the front foot pad and the stride pad to provide a preferred stride distance for the user.

DETAILED DESCRIPTION

Figure 3:
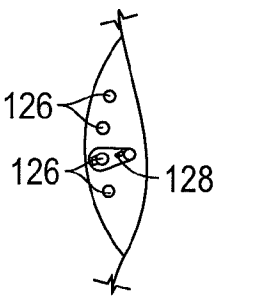
FIG. 3 is a top view of a pinwheel assembly according to an exemplary embodiment of the present invention.

Like reference characters denote like parts in the several drawings.

Exemplary embodiments of the present invention provide a training device that may be used to teach or train batting stance, foot placement, stride and swing skills for baseball or softball. Embodiments of the present invention include a rear foot pad having at least one release point positioned so as to force the ball of the rear foot to spring during a swing, allowing the batter to release the hips and body throughout the swing while maintaining the alignment of the rear footpad for repeated use. In certain embodiments, the rear foot pad may pivot relative to an extension bar such that the training device may be switched between a right-handed and a left-handed batting stance. Other embodiments provide release points disposed at opposite sides of a rear foot pad such that the training device may be used interchangeably for right-handed and left-handed batters without rotating the rear foot pad.

Embodiments of the present invention provide an adjustable first extension bar disposed between the rear foot pad and a front foot pad. The adjustable first extension bar allows for the width of a batter's stance to be adjusted for each batter. The front foot pad may include an adjustable attachment assembly allowing the front foot pad to be adjusted in front of or behind a linear path formed by the first extension bar. The adjustable assembly allows the device to accommodate open and closed stances for more advance training techniques. Embodiments having a first extension bar may also have a second extension bar extending between the front food pad and a stride pad. The second extension bar may lie along the linear path of the first extension bar such that the device has a single linear path between the rear foot pad and the stride pad, with the front foot pad adjustable out of the linear path. The second extension bar may be adjustable allowing the distance between the front foot pad and the stride pad to be adjusted to accommodate different stride lengths. Embodiments may not have a stride pad.

Embodiments of the present invention may have a main rail having a rear foot pad assembly attached at a first end of the main rail and a front foot pad assembly adjustably attached along the length of the main rail. The front foot pad assembly may be configured to slide along the main rail into a desired distance from the rear foot pad assembly and then lock into place via one or more pins. The front foot pad assembly may allow for arced rotation of a front foot pad relative to the main rail and may be locked into place via one or more pins. Embodiments of the present invention may include a stride pad assembly configured to slide along the main rail and lock into place via pins. The stride pad assembly may be configured to abut the front foot pad assembly.

Embodiments of the present invention provide a batting training device having a rear foot pad, a front foot pad and a stride pad disposed on a main rail. The rear foot pad may have one or more release points configured to allow a batter to rotate upon the ball of the rear foot during a batting swing. The front foot pad may be adjustable allowing for the device to be set up for an open stance, a neutral stance, a closed stance, or any adjusted location between said stances. The open stance configuration may allow a batter to stand with the front foot closer to either first base or third base while aligning a stride pad directly towards a pitcher.

Figure 1:
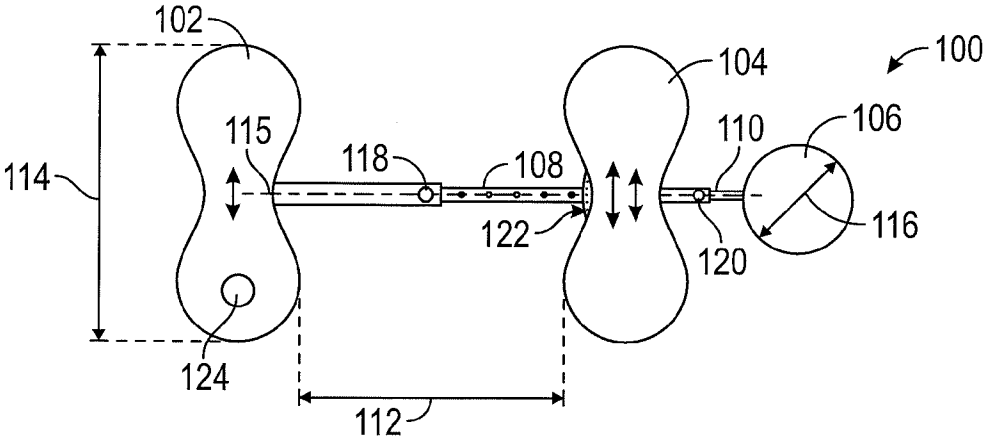
FIG. 1 is a top view of a training device according to an exemplary embodiment of the present invention.
Figure 2:
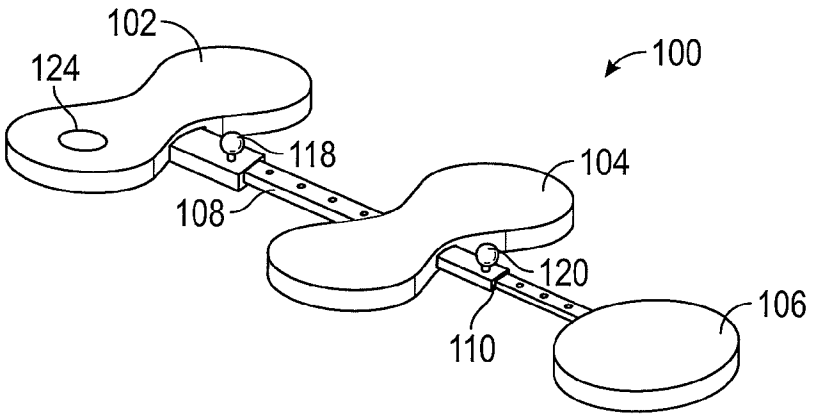
FIG. 2 is an isometric view of the training device shown in FIG. 1.
Figure 4:
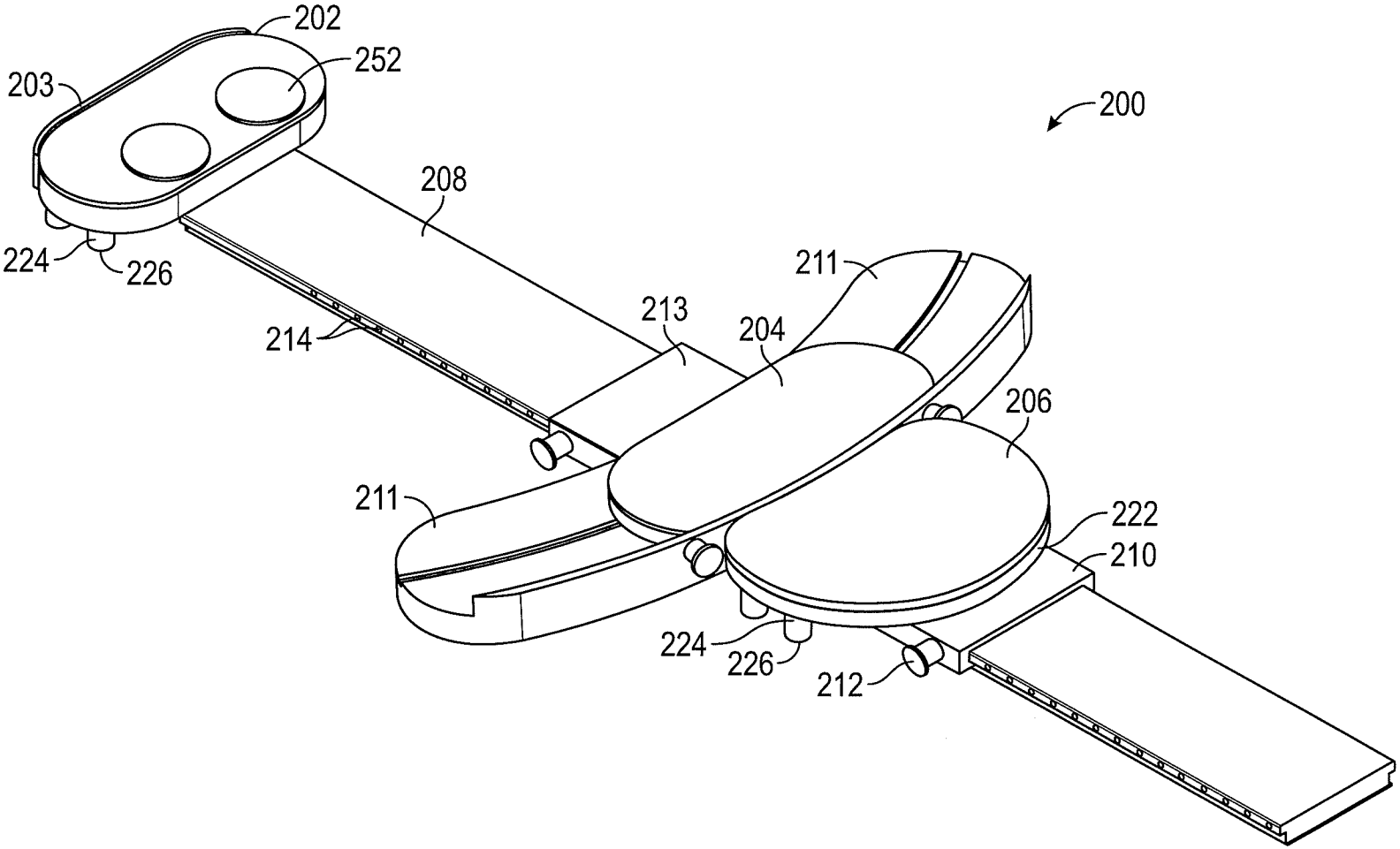
FIG. 4 is an isometric view of a training device according to an exemplary embodiment of the present invention.
Figure 5:
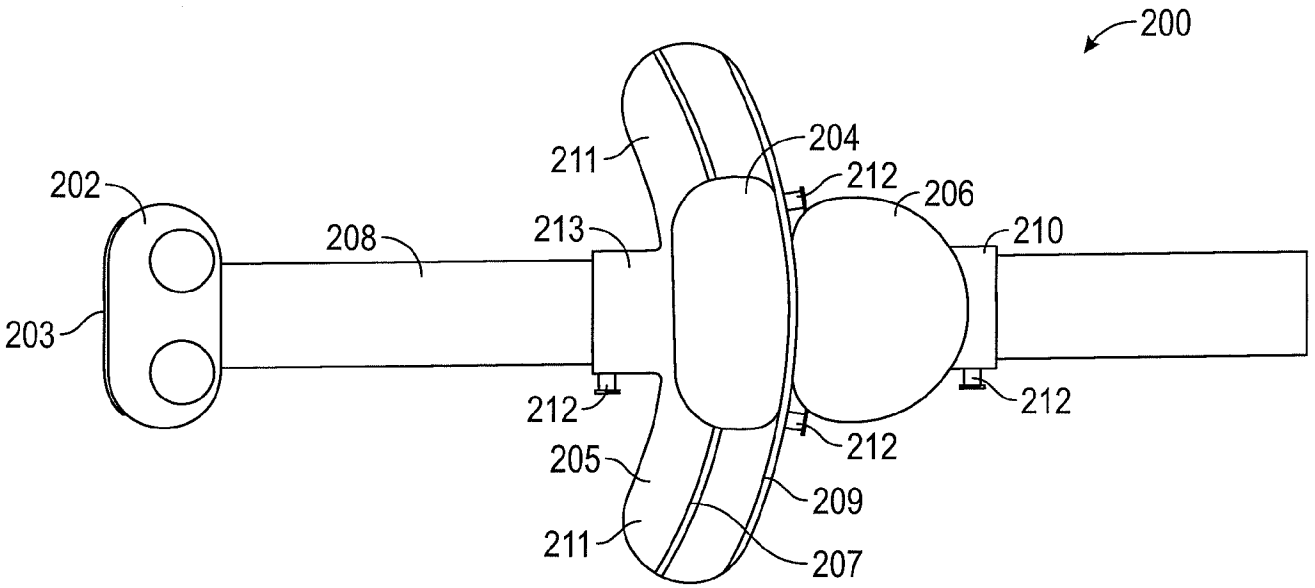
FIG. 5 is a top view of the training device shown in FIG. 4.
Figure 6:
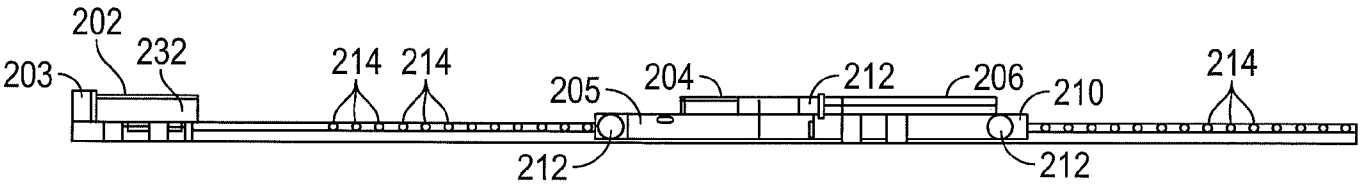
FIG. 6 is a side view of the training device shown in FIG. 4.
Figure 7:
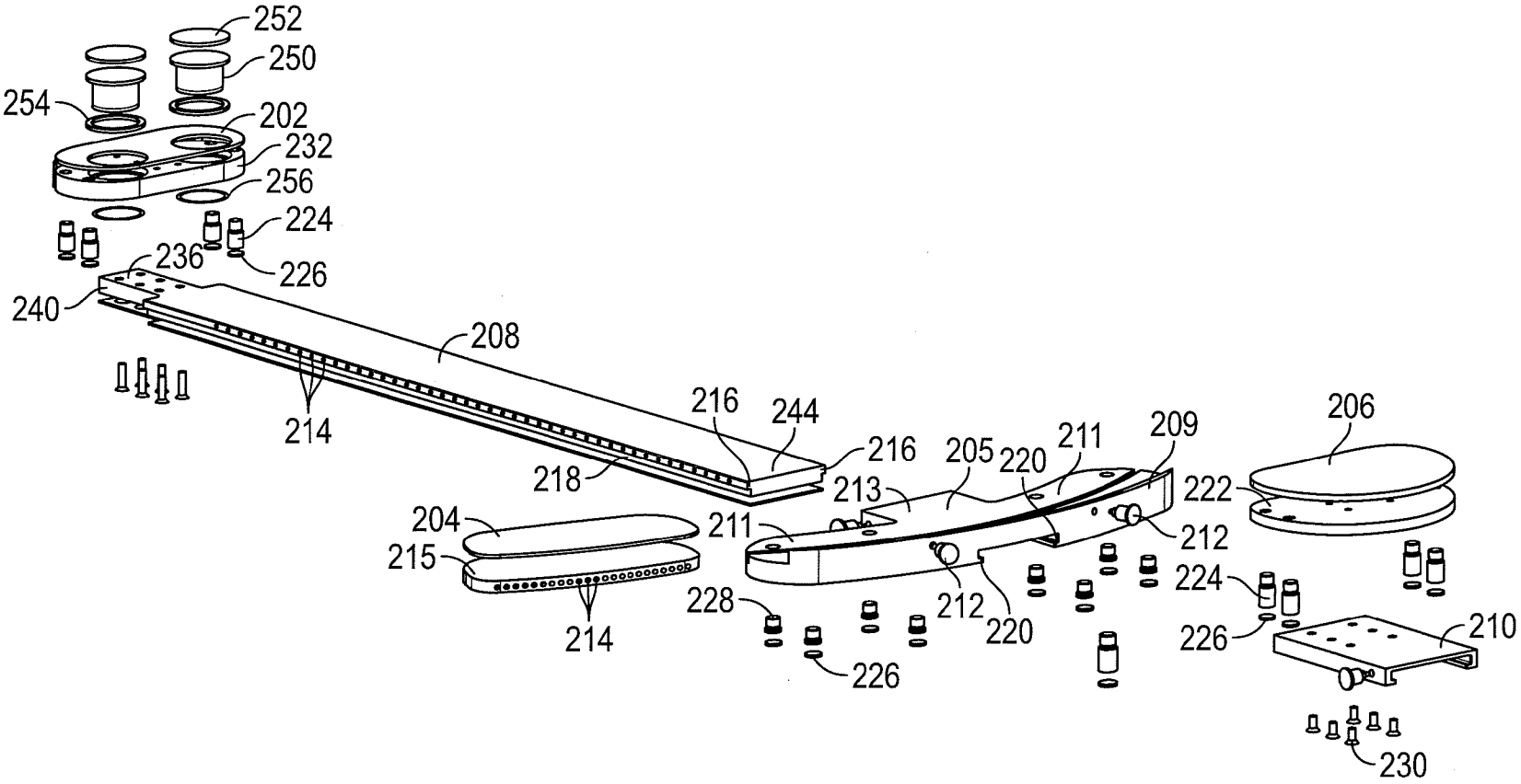
FIG. 7 is an exploded isometric view of a training device according to an exemplary embodiment of the present invention.
Figure 9:
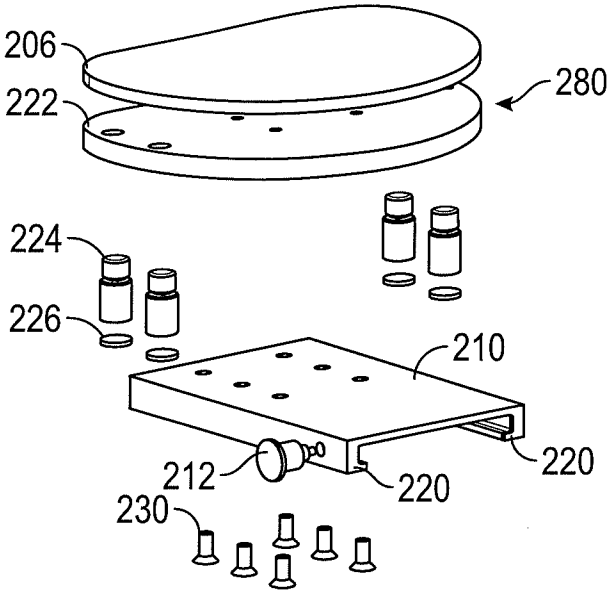
FIG. 9 is an exploded isometric view of a stride pad assembly according to an exemplary embodiment of the present invention.

Referring now to the example embodiment of FIGS. 1 and 2, an illustrative example of training device 100 is depicted having rear foot pad 102, front foot pad 104, and first extension bar 108 disposed between rear foot pad 102 and front foot pad 104. As shown, second extension bar 110 may be disposed between front foot pad 104 and stride pad 106. Rear foot pad 102 has a width 114 which may be approximately twelve inches. Front foot pad 104 may have a similar width. First extension bar 108 has adjustable width 112, which may be adjusted via pull pin 118. Similarly, second extension bar 110 has an adjustable width via pull pin 120. Front foot pad 106 has a diameter 116, which may be approximately six inches.

Front foot pad 104 includes pinwheel assembly 122, which is configured such that front foot pad 104 may be adjusted to allow for open, neutral and closed stances. See, e.g., FIG. 3. Pinwheel assembly 122 includes a plurality of adjustment apertures 126 and pinwheel lock 128. Pinwheel assembly 122 may include a plastic or metal (e.g., steel, aluminum, carbon fiber, etc.) base plate, with at least 4 adjustment apertures and a pinwheel lock, the integrated whole of which is attached to the underside of each footpad to allow for stance adjustments (from neutral to opened or closed) comfortable for the batter.

Rear foot pad 102 has a release point 124, which is configured to allow a batter to freely rotate the batter's rear foot at release point 124. Release point 124 is configured to align with the ball of a batters foot. Rear foot pad 102 includes pivot point 115 allowing the rear foot pad to rotate 180 degrees relative to first extension bar 108 such that the device may be configured for a right-handed stance (shown) or a left-handed stance (not shown). Other embodiments include two pivot points 115 allowing the device to be used interchangeably by left-handed and right-handed batters.

Optimally, the two extension bars are made of a durable but lightweight metal material, and are fitted with numerous holes aligned throughout the length of the bar in order to provide adjustability in the length of the system.

In one embodiment, first extension bar 108 connects the two foot pads 102 and 104, and is adjustable from approximately nine to approximately eighteen inches in length in order to accommodate users of various sizes and ages. Second extension bar 110 connects front foot pad 104 to stride pad 106 and is adjustable from at approximately four to approximately eight inches. Extension bars 108 and 110 adjust via pull pins 118 and 120, which lock the extension bars 108 and 110 into place at the appropriate distance for the batter's stance and stride. The pull pins 118 and 120 are then placed and locked into the holes on the extension bars, as matched by an adult or more experienced user. In one embodiment, the pull pins 118 and 120 are placed ½ inch apart for maximum adjustment capacity. With the pull pins 118 and 120 removed, the extension bars also allow for the device to collapse for easier storage, transportation, and assembly.

In an example embodiment, the foot pads are approximately 12 inches in length in order to accommodate various foot and shoe sizes, and are attached to the extension bar via a pinwheel lock assembly 122. This embodiment allows less experienced batters to maintain a neutral stance, while providing an option for more experienced batters to adjust their stance from neutral to either open or to closed, if desired.

In other embodiments, foot pads 102 and 104 comprise a plurality of rubberized materials, the bottom layer of the pad being formed from a polyurethane or another material that will adhere to concrete, cement or other hard surfaces, thereby keeping the invention stable during use; and a top layer comprising at least a rubberized polyurethane binder, disposed over a substrate. In still further embodiments, EPDM rubber granules or the like are provided and an aliphatic binder for wear resistance and shoe adherence.

In other embodiments, stride pad 106 comprises a hard rubber component, measuring approximately 6 inches in diameter, and is attached to second extension bar 110 outside front foot pad 104 via a pull pin for adjustment purposes, much like second extension bar 110 itself. In this embodiment, stride pad 106 is otherwise immobile. In still other embodiments, stride pad 106 and second extension bar 110 may be removed for the most inexperienced batters.

Turning now to the example embodiment of FIG. 2, possible adjustments to the device during use are illustrated with respect to foot pads 102 and 104, extension bars 108 and 110 and stride pad 106. In one example embodiment, a right-handed batter addresses device 100 and adjusts foot pad placement by adjusting extension bar 108 between the foot pads 102 and 104 for maximum comfort and fit and/or to adjust or remove stride pad 106.

Figure 8:
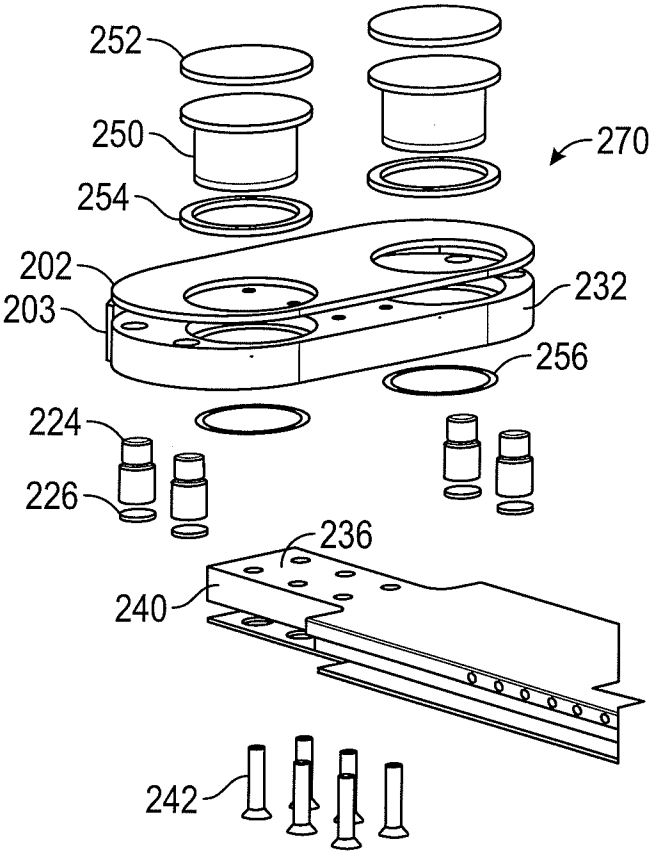
FIG. 8 is an exploded isometric view of a back foot pad assembly and a first end of a main rail of a training device according to an exemplary embodiment of the present invention.
Figure 10:
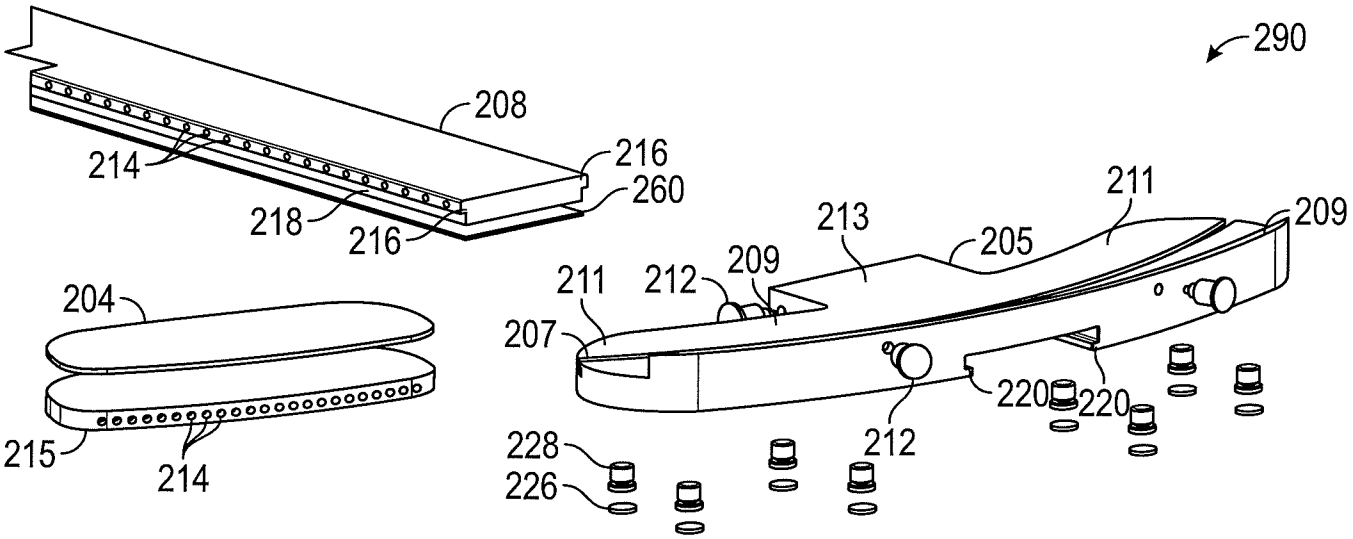
FIG. 10 is an exploded isometric view of a front foot pad assembly and a second end of a main rail of a training device according to an exemplary embodiment of the present invention.

Other embodiments of the present invention may include a main rail 208 having a front foot pad assembly 290, and rear foot pad assembly 270, and a stride pad assembly 280 attached to main rail 208. See, e.g., FIGS. 4 to 10. Rear foot pad assembly 270 may include rear foot pad 232 having rear foot pad liner 202 attached to a top portion of rear foot pad 232. See, e.g., FIG. 8. Rear foot pad assembly 270 may attach via long screws 242, which may be sink screws, to T-section 236 of first end 240 of main rail 208. Rear footpad assembly 270 may include at least one release point having a toe rotation pin 250 passing through rear foot pad liner 202 and rear foot pad 232 and held in place via snap ring 256. The release points may also include friction ring 254 and toe rotation liner 252. Release points allow a batter to release hips and body during a swing by facilitating rotation. Additionally rear foot pad assembly may include cleats 224 disposed at ends of the rear foot pad 232. Cleats 224 may also have liners 226. Cleats 224 may provide additional stability to rear foot pad assembly 270 when placed upon the ground and engaged by a batter. Rear foot pad assembly may include raised edge 203 which may serve to guide a batter's foot into position.

Embodiments of the present invention have a front foot pad assembly 290 having a front foot pad base 205 configured to adjustably attach to main rail 208 and front foot pad 215 configured to adjustably attach to front foot pad base 205. See, e.g., FIG. 10. Main rail 208 has extensions 216 on either side of main rail 208 and pin holes 214 disposed at intervals along extensions 216. Below extensions 216, along the length of main rail 208, run grooves 218. Front foot pad base 205 includes an open section having extensions 220. Front foot pad base 205 is configured such that it may slide over main rail 208 with extensions 220 engaging grooves 218 securing front foot pad base 205 to main rail 208. Trunk section 213 of front foot pad base 205 has pins 212 disposed on each side, which are configured to engage pin holes 214 along main rail 208. Pins 212 of trunk section 213 may be released to allow front foot pad base 205 to slide freely over main rail 208 and may be engaged to lock front foot pad base 205 in place at a desired location on main rail 208. In this way, a stance distance may be adjusted.

Embodiments of front foot assembly 290 include front foot pad 215 adjustably connected to front foot pad base 205. Front foot pad base 205 may include curved guide groove 207 extending between sides 211 of front foot pad base 205 and curved front edge 209 along a front portion of front foot pad base 205. Guide groove 207 and front edge 209 may be used as guides in the adjustment of front foot pad 215 relative to front foot pad base 205. Front foot pad 215 may be adjusted (moved) toward either side 211 such that a batter's stance may be adjusted between neutral, open or closed, as desired. The present invention allows for the stance to be comfortably adjusted into open or closed positions while maintaining proper stride direction toward the pitcher along mail rail 208.

When satisfactory adjusted, front foot pad 215 may be locked into place by pins 212 located along front edge 209, which pins 212 are configured to engage pin holes 214 disposed along an edge of front foot pad 215. In this way, the desired stance may be locked and repetition with the desired stance may be accomplished. Front foot pad 215 may include front foot pad liner 204. Front foot pad assembly 290 may include a plurality of cleats 228, which may be shorter than cleats 226. Cleats 228 may be attached to front foot pad base 205 and engage the ground to provide stability to the device when in use. Cleat liners 226 may be attached to cleats 228.

Embodiments of the present invention may further include stride pad assembly 280, which may include stride pad 222, stride pad liner 206 and stride pad base 210. See, e.g., FIG. 9. Stride pad 222 may be secured to stride pad base 210 via screws 230. Similar to front foot pad base 290, stride pad base 210 is configured to engage main rail 208 via grooves 218 of mail rail 208 and extensions 220 of stride pad base 210. Stride pad base 210 may slide over main rail 208 until in a desired location and may be secured via pins 212 on each side of stride pad base 210. Stride pad assembly 280 may also include cleats 224 and cleat covers 226 to provide additional stability to the device in use.

Figure 11:
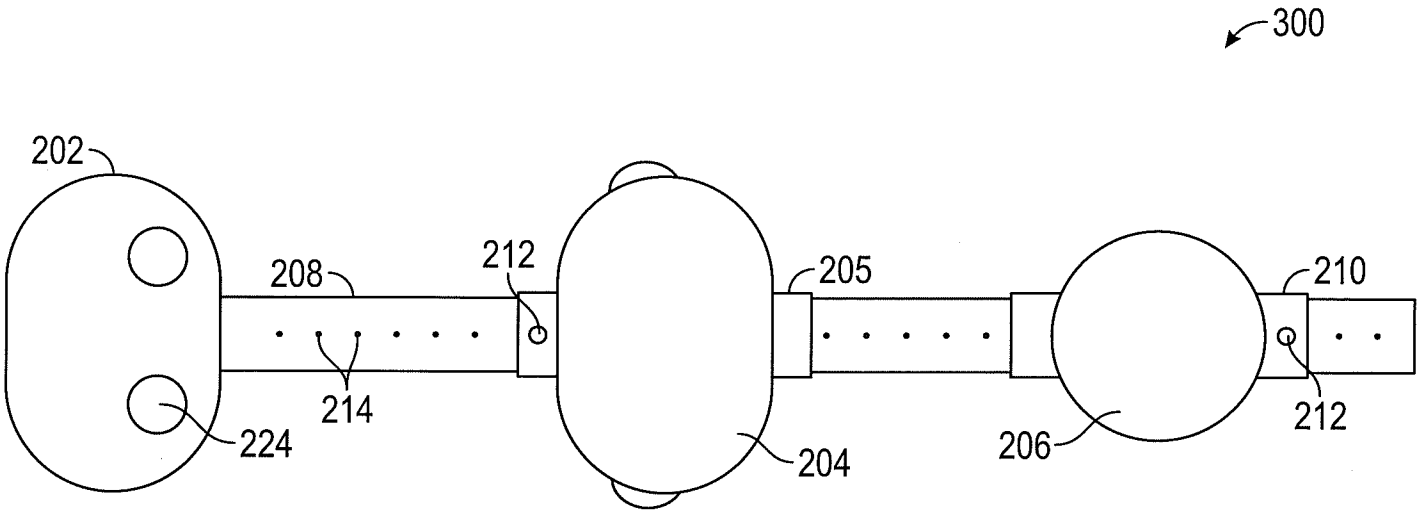
FIG. 11 is a top view of a training device according to an exemplary embodiment of the present invention.

In alternate embodiments, device 300 may have main rail 208 with pin holes 214 disposed on a top surface of main rail 308. See, e.g., FIG. 11. Pins 212 may be disposed amongst the pad assemblies such that pins 212 may engage pin holes 214 along the top surface of main rail 208. Although discussed as pins 212 and pin holes 214, the pad assemblies discussed herein may be secured via any combination of adjustable connections, including pins/pin holes, clamping, and screws.

Embodiments of the present invention provide a method of teaching batting skills using a device having a rear foot pad with at least one release point, a front foot pad and a stride pad. The front foot pad is adjustable such that it may be adjusted out of linear alignment between the rear foot pad and the stride pad to accommodate open and closed stances. A distance between the rear foot pad and the front foot pad is adjusted for a comfortable stance distance along with adjustments to account for open and closed positions. The stride pad is attached to accommodate a comfortable stride distance. The pads are locked into place and the device is used to demonstrate proper foot placement and alignment, batting stance, and body movement during a batting swing.

The foregoing detailed description is intended primarily for illustrative purposes, and is not intended to include all possible aspects of the present invention. Moreover, while the invention has been shown and described with respect to an exemplary embodiment, those of skill in the pertinent art should appreciate that the foregoing detailed description, and various other modifications, omissions and additions, so long as in the general form and detail thereof, may be made without departing from either the spirit or scope of the present invention.

What is claimed is:

1. A batting training device, comprising;
a rear foot pad having at least one release point; and
a front foot pad, further comprising a pinwheel assembly configured to allow adjustment thereof;
wherein the front foot pad is adjustable, allowing for a range of closed and open stance alignments;
wherein the at least one release point is configured to allow a user of the device to pivot at the at least one release point during a batting swing.

2. The training device of claim 1, further comprising: a stride pad.

3. The training device of claim 1, further comprising:
a first extension bar disposed between the rear foot pad and the front foot pad;
wherein the first extension bar is adjustable such that a distance between the rear foot pad and the front foot pad may be increased or decreased.

4. The training device of claim 3, further comprising:
a second extension bar disposed between a stride pad and the front foot pad;
wherein the second extension bar is adjustable such that a distance between the stride pad and the front foot pad may be increased or decreased; and
wherein the second extension bar is removably attached to the front foot pad such that the second extension bar and the stride pad may be detached from the training device.

5. The training device of claim 1, further comprising: two release points located in the rear foot pad;
wherein a first release point allows for right-handed training and a second release point allows for left-handed training.

6. The training device of claim 4, wherein the first and second extension bars include pull pins and a plurality of pin holes configured to lock the first and second extension bars into place.

7. The training device of claim 1, wherein the rear foot pad is reversible.

8. The training device of claim 1, further comprising;
a main rail;
a rear foot pad assembly;
front foot pad assembly; and
a stride pad assembly;
wherein the rear foot pad assembly is attached to a first end of the main rail and the front foot pad assembly adjustably attaches to the main rail at a variety of distances from the rear foot pad assembly.

9. The training device of claim 8, wherein the stride pad assembly adjustably attaches to the main rail at a variety of distances from the front foot pad assembly.

10. The training device of claim 8, further comprising two release points.

11. The training device of claim 9, wherein the stride pad assembly and the front foot pad assembly include pins configured to engage pin holes along the main rail such that the stride pad assembly and the front foot pad assembly can be locked into place at desired locations along the main rail.

12. The training device of claim 8, wherein the rear foot pad assembly comprises:
the rear foot pad;
support cleats; and
a rear foot pad liner.

13. The training device of claim 8, wherein the front foot pad assembly comprises:
a front foot pad base adjustably attached to the main rail; and
the front foot pad adjustably attached to the front foot pad base;
wherein the front foot pad base is configured to allow the distance between the rear foot pad assembly and the front foot pad assembly to be adjusted; and wherein the front foot pad and the front foot pad base are configured to allow the front foot pad to be locked into place at locations along the front foot pad base such that a batter's stance alignment may be adjusted to an open stance, a closed stance, or a neutral stance.

14. The training device of claim 1, wherein a distance between the front foot pad and rear foot pad is adjustable from approximately 9 inches to approximately 18 inches.

* * * * *